US005433234A

United States Patent [19]

Lapere

[11] Patent Number: 5,433,234

[45] Date of Patent: Jul. 18, 1995

[54] SUPPORTIVE DEVICE FOR WALKING

[76] Inventor: Samuel Lapere, 3505 20th, Wyandotte, Mich. 48192

[21] Appl. No.: 18,031

[22] Filed: Feb. 16, 1993

[51] Int. Cl.[6] ..... A45B 3/00

[52] U.S. Cl. ..... 135/66; 135/77; 135/81

[58] Field of Search ..... 135/65, 66, 81, 70, 135/77

[56] References Cited

U.S. PATENT DOCUMENTS

| | | | |
|---|---|---|---|
| 341,715 | 5/1886 | Allen . | |
| 889,035 | 5/1908 | Newsom . | |
| 954,473 | 4/1910 | Schocke . | |
| 1,050,124 | 1/1913 | Greeno . | |
| 1,473,527 | 11/1923 | Thimgren . | |
| 1,905,076 | 4/1933 | Van Sciver . | |
| 2,346,038 | 4/1944 | Mason . | |
| 2,836,188 | 5/1958 | Jordan . | |
| 3,038,483 | 6/1962 | Altsheler . | |
| 3,456,663 | 7/1969 | Blum . | |
| 3,467,116 | 9/1969 | Ringewaldt | 135/66 |
| 3,763,872 | 10/1973 | Gooley | 135/66 |
| 3,901,258 | 8/1975 | Montgomery | 135/81 |
| 4,299,246 | 11/1981 | Marsh | 135/66 |
| 4,811,750 | 3/1989 | McAllister | 135/66 |
| 4,827,956 | 5/1989 | Toot | 135/66 |
| 5,176,160 | 1/1993 | Osborn | 135/66 |

FOREIGN PATENT DOCUMENTS

| | | | |
|---|---|---|---|
| 2523418 | 9/1983 | France | 135/77 |
| 1583079 | 8/1990 | U.S.S.R. | 135/81 |

*Primary Examiner*—Carl D. Friedman
*Assistant Examiner*—Wynn E. Wood
*Attorney, Agent, or Firm*—Gifford, Groh, Sprinkle, Patmore and Anderson

[57] ABSTRACT

A cane or walking stick includes a grasping mechanism and optionally includes prongs for providing the user with traction in ice or snow. The preferred embodiment includes a scissor action grasping mechanism that is controlled by the user of the cane. The grasping mechanism is disposed at the lower end of the cane, while the handle for controlling the grasping mechanism is strategically provided by the handle of the cane. The jaws of the grasping mechanism may be optionally foldable from a stored, out-of-the-way position to an extended position for use. To provide traction, the ends of the jaws may be provided with grips such as prongs. Similarly, the end of the cane may also be provided with a prong, and the prong may be retracted for indoor use on floors and the like and for use out- of-doors during warm weather.

17 Claims, 2 Drawing Sheets

SUPPORTIVE DEVICE FOR WALKING

BACKGROUND OF THE INVENTION

I. Field of the Invention

The present invention relates generally to supportive devices for walking. More particularly, the present invention relates to a supportive device for walking having attached thereto a grasping mechanism. Optionally provided on the supportive device are prongs for providing the user with traction in ice or snow.

II. Description of the Relevant Art

Supports for walking are commonly provided in the forms of canes or walking sticks. At one time it was very popular for gentlemen to use walking sticks to satisfy the demands of fashion. This is still the case in some cultures.

Walking sticks have taken on many forms. They have been modified to include umbrellas and concealed weapons. However, for the most part, like the dress walking stick used to comply with fashion trends, these modifications have also been made for use by people who really do not need support.

For the most part, people use canes or walking sticks because they suffer from an ailment or an ancient injury that limits their mobility. The cane is used to provide the user having unsure legs with a "third leg" of certain dependability.

People who depend upon a cane for support in motion have an interest in generally limiting their mobility for the same reason they need the cane in the first place: it is simply difficult to get about. Some of these people live alone or, if living with others, generally prefer not to have to trouble other people for assistance. This becomes a problem, however, when the cane user requires an article of manageable size that is available, but is out of reach. Even if this article is only a few feet away, if it is beyond the arm's length of the individual, this becomes a problem.

A method of allowing a cane user the ability to use the cane for increasing his reach seemed useful, and indeed, in some situations and according to the needs of the particular individual, a necessity.

In U.S. Pat. Nos. 2,346,038 and 2,836,188, issued to Mason (on Apr. 4, 1944) and Jordan (on May 27, 1958), respectively, pickup canes are disclosed. Both patents illustrate canes having a single retractable finger-like extension that utilizes the base of the cane as the fixed cam and the extension as the movable jaw. While providing a rudimentary method of grasping, both of these devices suffer from the limitation that the single extension is not able to efficiently grasp articles.

Accordingly, there still remains the need for a cane or walking stick that is capable of assisting the user in efficiently grasping and carrying articles. With such a device, the user need not move from a resting position every time he needs to bring an article close.

SUMMARY OF THE PRESENT INVENTION

The present invention provides a supportive device for walking that includes a grasping mechanism that overcomes the problems and limitations of known canes. The grasping mechanism includes a pair of jaws that operate with scissor-like action to grasp articles that cannot be grasped by canes having a single jaw.

The grasping mechanism is disposed at the lower end of the cane, while the handle for controlling the grasping mechanism is strategically provided by the handle of the cane. A control rod is provided between the pair of jaws and the handle. A spring is provided to hold the jaws in an open position by providing resistance against the jaws at a point about which they pivot.

The pair of jaws are optionally constructed so that they are able to reversibly pivot from a stored, out-of-the way position to an extended, operational position.

To further increase the general utility of the present invention, the cane is provided with accessories that increase traction on ice or snow. The tip of conventional canes is well suited for tile, wood or linoleum floors, and has some advantage on pavement. However, in snow or ice, this attachment is quite useless.

To overcome this limitation, the present invention is provided with grips fashioned as prongs on the ends of the jaws. A third grip is optionally provided as a retractable prong on the end of the cane.

Other advantages and features of the present invention will become apparent from the following detailed description.

BRIEF DESCRIPTION OF THE DRAWINGS

The present invention will become more fully understood by reference to the following detailed description of the preferred embodiments of the present invention when read in conjunction with the accompanying drawings in which like reference characters refer to like parts throughout the views, and in which.

DETAILED DESCRIPTION OF THE PREFERRED EMBODIMENT OF THE PRESENT INVENTION

The drawings disclose the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
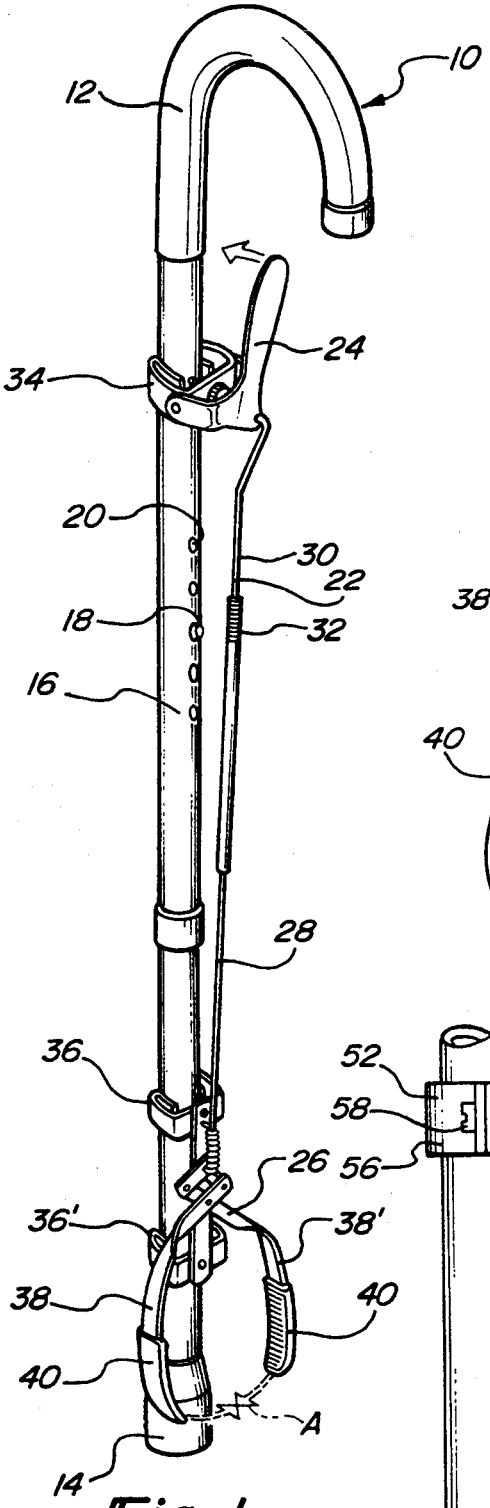
FIG. 1 is a perspective view of the preferred embodiment of the present invention.

Referring to FIG. 1, a supportive device according to the present invention is illustrated, and is generally indicated as 10. The device 10 includes an upper handle region 12 and a lower ground-contacting region 14. An elongated member 16 interconnects the handle region 12 and the ground-contacting region 14. The elongated member 16 is shown here as being adjustable by means of a button 18 that may be selectively fitted into one of several button-receiving holes 20.

A grasping mechanism is provided and is shown as 22. The mechanism 22 includes a handle 24 and a jaw assembly 26. Interconnecting the handle 24 and the jaw assembly 26 is a connecting rod 28. The length of the rod 28 may be adjusted by threading an upper rod half 30 into or out of the thread-receiving lower rod half 32.

The handle 24 is pivotably attached to a handle bracket 34. According to this type of bracket 34, the assembly is snapped onto the elongated member 16. Other brackets are illustrated and discussed below.

The jaw assembly 26 is similarly attached to the elongated member 16 by means of a pair of brackets 36, 36'. The jaw assembly 26 includes a pair of movable jaws 38, 38'. The jaws 38, 38' are movable from a grasping to a non-grasping position as illustrated by the arrows "A". To improve the grasp of the movable jaws 38, 38', each is fitted with a sleeve 40 preferably composed of a polymerized material.

Figure 2:
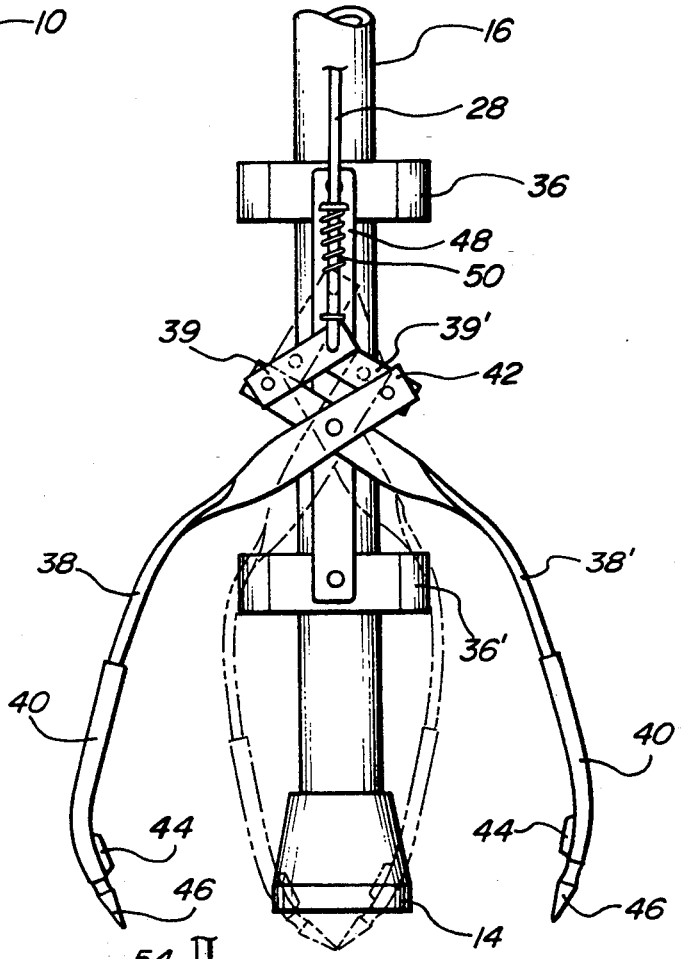
FIG. 2 is a detailed view showing the jaws of the grasping mechanism of the present invention.

Referring to FIG. 2, a close-up, detailed view of the jaw assembly 26 is illustrated looking at it from a front view. This view clearly illustrates the expanded, non-grasping position of the jaws 38, 38'. The grasping position of the jaws 38, 38' is shown in shadow lines. A pair of intermediate arms 39, 39' pivotably interconnect the jaws 38, 38' and the connecting rod 28.

The jaw assembly 26 includes, in addition to the jaws 38, 38', a fixed base 48. The base 48 is attached to the elongated member 16 by means of the brackets 34, 34'. Furthermore, the jaw assembly 26 includes a return spring 50 that provides resistance such that the jaws 38, 38' are maintained in an open, non-grasping position when at rest. This open position is very useful when the device 10 is fitted with the optional traction accessories, as discussed below.

A pivoting assembly 42 provides the jaws 38, 38' with the leveraging necessary to furnish strong grasping movement of the jaws 38, 38'. As may be understood, this construction provides the jaw assembly 26 with increased force, thereby allowing the user to pick up and firmly grasp even otherwise hard-to-hold articles.

To further increase the grasping ability of the jaw assembly 26, each sleeve 40 preferably includes a raised holding pad 44. The pad 44 is preferably composed of a resilient material, thereby allowing the user to maintain a firm grasp on the selected article, even if it is of a delicate nature.

As discussed above, a further feature of the present invention is increased traction for use on ice and the like. This traction is provided for in the form of prongs 46 that are optionally provided at the ends of each of the jaws 38, 38'. The prongs 46 provide the user with a proper grasp of the ice. The prongs 46 may be replaced with cleats or multi-pointed assemblies (not shown).

As noted above, when fitted with the optional prongs 46, the spaced apart, at rest position of the jaws 38, 38' provides the device 10 with considerable traction and stability.

Referring to FIG. 2, a detailed side view of the jaw assembly 26 is illustrated. This view more clearly illustrates the relationship between the pivoting assembly 42 and the end of the connecting rod 28, which is bent in an "L" shape to cooperate with openings in the pivoting assembly 42.

As noted above, the base 48 of the jaw assembly 26 is fixedly attached to the elongated member 16. The brackets 36, 36' shown and discussed above with respect to FIG. 1 are of the snap type, frictionally held in place on the elongated member 16. However, to more permanently fix the jaw assembly 26 (and the handle 24 [not shown]) to the elongated member 16, the base 48 may be fitted thereto by means of permanent clamps 52, 52'. These clamps are of the clam shell type, and include a bottom half 54 (attached to the base 48) and a top half 56. A fastener 58 is provided to hold one half to the other.

It should be understood that while the embodiments illustrated show the handle 24 and the jaw assembly 26 fixed to the elongated member 16 by means of clamps, it is also envisioned that the handle 24 and the assembly 26 may be fixed directly to the member 16 by means of fasteners such as screws, or, in the event that the member 16 is composed of a polymerized material, may be attached to molded fittings. It should also be noted that certain portions of the grasping mechanism 33, such as the connecting rod 40, may be included inside the elongated member 16.

Figure 3:
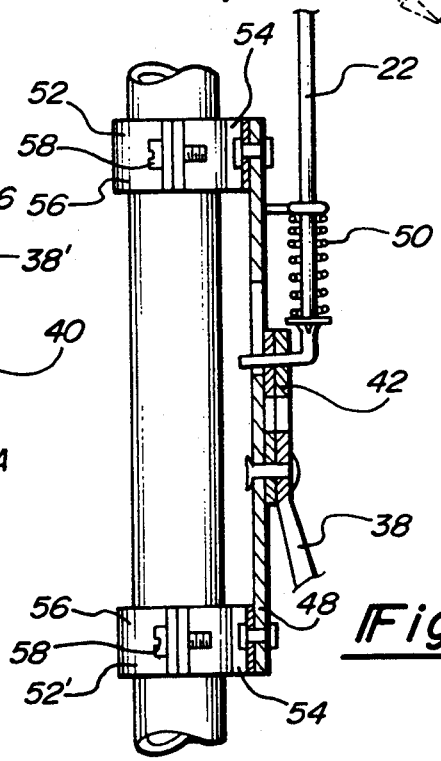
FIG. 3 is a side view of the support bracket for the jaws illustrated in FIG. 2.
Figure 4:
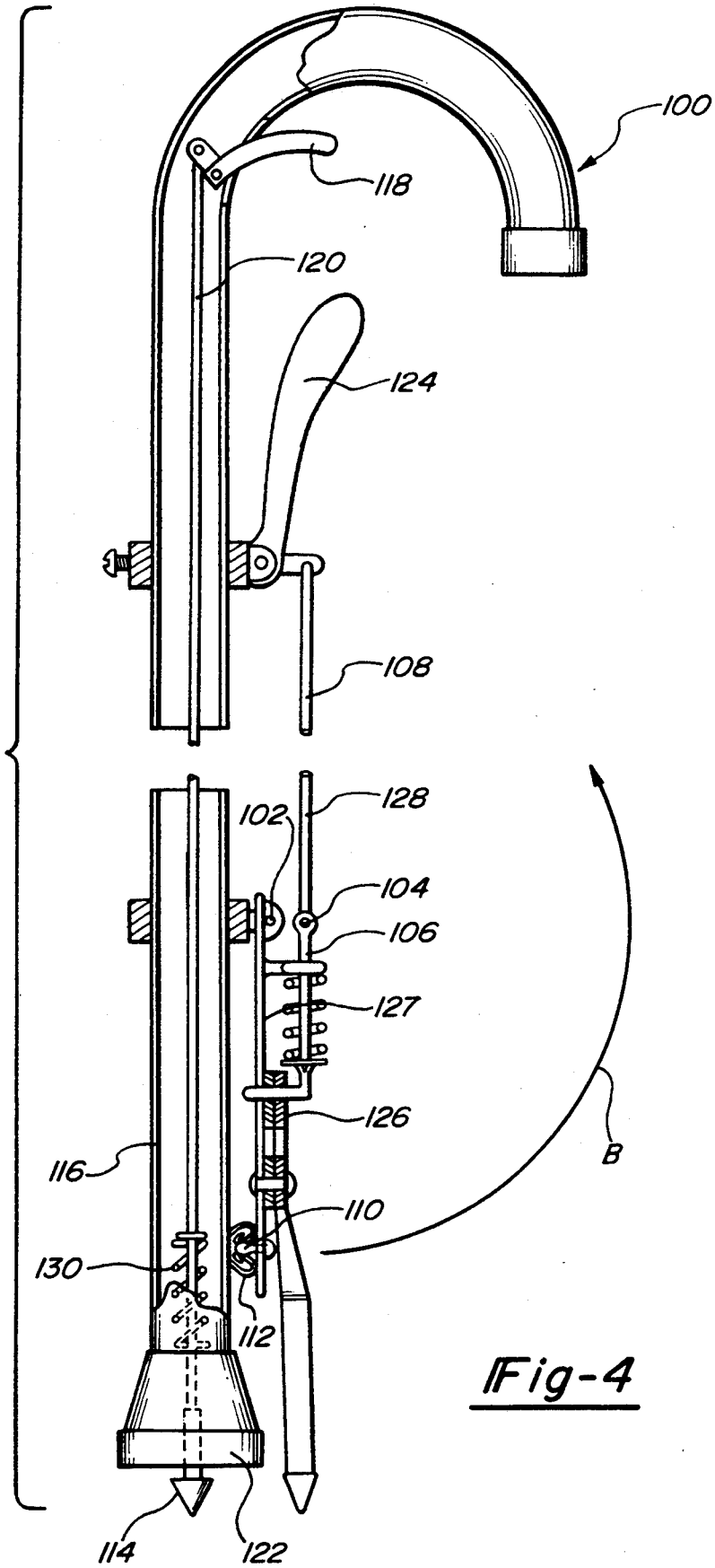
FIG. 4 is a partially sectional view of an alternate embodiment of the present invention.

Referring to FIG. 4, a supportive device, generally illustrated as 100, is shown. This device 100 is an alternate embodiment of the device 10 discussed above and shown in FIGS. 1 through 3.

According to this embodiment, a handle 124 is provided to operate a jaw assembly 126. These components are substantially identical to their counterparts discussed above with respect to FIGS. 1 through 3 except the jaw assembly 126, which includes an assembly base 127, is itself pivotably attached to the member 116 such that the assembly 126 may be reversibly swung from an operational position as illustrated to a stored position (not illustrated) by pivoting the assembly 126 at pivot point 102 in the direction of arrow "B". A pivoting knuckle 104 is fitted on a connecting rod 128 to interconnect a lower rod half 106 and an upper rod half 108.

In its down-folded, operational position, the jaw assembly 126 is held to an elongated member 116 by a snap-type fastener that includes a plunger 110 and a plunger receptacle 112. The user selectively moves the jaw assembly 126 from one position to the other.

To further enhance the traction of the present invention when used on ice, and in addition to the prongs 46 identified with respect to FIG. 2, a third grip, a prong 114, is retractably provided at the ground-contacting end of the member 116. The prong 114 may be selectively controlled by the user by operation of a trigger 118. When the trigger 118 is squeezed, an interconnecting shaft 120 extends the prong 114 beyond the base of a tip 122 provided at the end of the member 116. A spring 130 provides slight resistive force to return the prong 114 into the end of the member 116 when not in use, thus allowing the device 100 to be used on other, non-iced surfaces without leaving scratches.

When the prong 116 is used in conjunction with the prong 46 described above, a three-point support system is provided, thus giving the user not only considerable traction on ice, but also remarkable stability. The stability feature, of course, may also be achieved on embodiments of the present invention that do not have the traction feature, but nevertheless have the advantage of three-point support as provided by the tip of the cane and the tips of the jaws.

Having described my invention, however, many modifications thereto will become apparent to those skilled in the art to which it pertains without deviation from the spirit of the invention as defined by the scope of the appended claims.

I claim:

1. A supportive device for walking, said device comprising:

a substantially elongated member having an upper handle portion and a lower ground-contacting portion;

a scissor-action grasping mechanism, said scissor-action grasping mechanism being attached to said elongated member substantially near said ground-contacting portion;

an operating handle, said operating handle being attached to said elongated member substantially near said upper handle portion;

a connecting rod, said connecting rod having an operating handle attachment end and a grasping mechanism attachment end, said connecting rod operably interconnecting said operating handle and said grasping mechanism;

said scissor-action grasping mechanism comprising a first grasping arm and a second grasping arm, said grasping arms each having a grasping end and intermediate arm attachment end, said grasping arms being pivotably interconnected said mechanism further including a first intermediate arm and a second intermediate arm, each of said arms having grasping arm attachment end and a connecting rod attachment end, said grasping arm attachment end of said first intermediate arm being pivotably connected to said intermediate arm attachment end of said first gasping arm and said connecting rod attachment end of said first intermediate arm being attached to said grasping mechanism end of said connecting rod, said grasping arm attachment end of said second intermediate arm being pivotably connected to said intermediate arm attachment end of said second grasping arm and said connecting rod attachment end of said second intermediate arm being attached to said grasping mechanism end of said connecting rod.

2. The supportive device for walking of claim 1 wherein said grasping mechanism further includes means for operating said mechanism.

3. The supportive device for walking of claim 2 wherein said means for operating comprises a handle provided in conjunction with said upper handle portion.

4. The supportive device for walking of claim 1 wherein said pivotably-connected jaws are pivotably provided on said elongated member whereby said jaws may be reversibly moved from a first stored position to a second extended position for use.

5. The supportive device for walking of claim 4 further including means for traction.

6. The supportive device for walking of claim 5 wherein said jaws include gripping ends and said means for traction comprises grips provided on said gripping ends of said laws.

7. The supportive device for walking of claim 6 wherein said means for traction further comprises a retractable grip provided on said ground-contacting portion of said elongated member.

8. The supportive device for walking of claim 1 further including means for traction.

9. The supportive device for walking of claim 8 wherein said jaws include gripping ends and said means for traction comprises grips provided on said gripping ends of said laws.

10. The supportive device for walking of claim 9 wherein said means for traction further comprises a retractable grip provided on said ground-contacting portion of said elongated member.

11. A supportive device for walking, said device comprising:

an elongated member, said elongated member having a handle end and a floor-contacting end;

a scissor-action grasping mechanism assembly provided on said elongated member;

means for operating said grasping mechanism;

said scissor-action grasping mechanism assembly including a pair of pivotably interrelated jaws and an assembly base, each of said jaws having gripping end, said jaws being attached to said base, said base having an upper end and a lower end, said upper end of said base including a pivot knuckle, said pivot knuckle being pivotably attached to said elongated member, whereby said assembly may be reversibly swung from an operational position where said gripping ends of said jaws extend beyond said floor-contacting end of said elongated member, to a stored position where the grasping ends of said jaws generally point toward said handle end of said elongated member.

12. The supportive device for walking of claim 11 further including means for traction.

13. The supportive device for walking of claim 12 wherein means for traction comprises a grip provided on each of said gripping ends of said jaws.

14. The supportive device for walking of claim 13 wherein said elongated member includes a ground-contacting end, said ground-contacting end including an end grip.

15. The supportive device for walking of claim 14 wherein said end grip is retractable.

16. A supportive device for walking, said device comprising:

an elongated member, said elongated member having a handle end and a floor-contacting end;

a mechanism for grasping provided on said elongated member, said mechanism including a pair of arms, said mechanism being pivotably attached to said elongated member, said mechanism being reversibly movable from a stored position where said pair of arms generally point toward said handle end of said elongated member to an operational position where said pair of arms generally point to said floor-contacting end of said elongated member; and means for traction, said means for traction being attached to said grasping mechanism.

17. The supportive device for walking of claim 16 wherein said ground-contacting end is provided with a prong.

* * * * *